US010029351B2

(12) United States Patent
Hopf

(10) Patent No.: US 10,029,351 B2
(45) Date of Patent: Jul. 24, 2018

(54) CLAMPING TOOL

(71) Applicant: Steven L Hopf, Riverside, CA (US)

(72) Inventor: Steven L Hopf, Riverside, CA (US)

( * ) Notice: Subject to any disclaimer, the term of this patent is extended or adjusted under 35 U.S.C. 154(b) by 0 days.

(21) Appl. No.: 15/288,359

(22) Filed: Oct. 7, 2016

(65) Prior Publication Data

US 2017/0225301 A1 Aug. 10, 2017

Related U.S. Application Data

(60) Provisional application No. 62/388,770, filed on Feb. 8, 2016.

(51) Int. Cl.

| | |
|---|---|
| ***B25B 5/00*** | (2006.01) |
| ***B25B 5/10*** | (2006.01) |
| ***B25B 5/16*** | (2006.01) |

(52) U.S. Cl.

CPC ..... *B25B 5/101* (2013.01); *B25B 5/163* (2013.01); *B25B 5/166* (2013.01)

(58) Field of Classification Search

USPC ..... 269/249, 250, 251, 252, 253

See application file for complete search history.

(56) References Cited

U.S. PATENT DOCUMENTS

| | | | | |
|---|---|---|---|---|
| 742,647 | A | 10/1903 | Herriman | |
| 1,042,610 | A | 1/1912 | Schulz | |
| 1,421,220 | A | 6/1922 | Hart | |
| 1,429,050 | A | 9/1922 | Sylvester | |
| 1,716,887 | A | 6/1929 | Griesell | |
| 2,696,240 | A | 12/1954 | Crowder | |
| 3,151,897 | A | 10/1964 | Wagner | |
| 3,220,721 | A | 11/1965 | Wahli et al. | |
| 3,729,974 | A | 5/1973 | Tidwell | |
| 4,089,201 | A | 5/1978 | Raptis | |
| 4,116,035 | A | 9/1978 | Malarsky | |
| 4,691,907 | A * | 9/1987 | Yang | B25B 5/003 269/152 |
| 4,874,155 | A | 10/1989 | Goul | |
| 4,930,335 | A | 6/1990 | Ishihara | |
| 5,222,420 | A | 6/1993 | Sorensen et al. | |
| 5,326,076 | A | 7/1994 | Sorensen et al. | |
| 6,170,813 | B1 * | 1/2001 | Bowers | B25B 1/2452 269/282 |
| 6,568,667 | B1 | 5/2003 | Hall | |
| 6,648,315 | B1 | 11/2003 | Lee | |
| 7,614,617 | B2 | 11/2009 | Marusiak | |

(Continued)

*Primary Examiner* — Joseph J Hail
*Assistant Examiner* — Shantese McDonald
(74) *Attorney, Agent, or Firm* — Kevin Abecbeck

(57) ABSTRACT

A clamping tool of the type including a C-shaped body and a drive screw with a threaded portion in mechanical communication with a threaded receiver in one end of the C-shaped body and including at least two threaded receivers in one end of the C-shaped body, each adapted to separately and independently receive and support the threaded portion of the drive screw. A backstop may be included with a backstop pin extending from a surface of the backstop and at least two non-collinear backstop bushings in a second end of the C-shaped body. The at least two non-collinear backstop bushings may each be adapted to receive and support the backstop pin of the backstop, thereby providing more than one position of the backstop on the C-shaped body.

24 Claims, 15 Drawing Sheets

(56) References Cited

U.S. PATENT DOCUMENTS

| | | | | |
|---|---|---|---|---|
| 7,891,618 | B2 * | 2/2011 | Carnevali | A47B 21/0314 248/228.5 |
| 8,567,292 | B1 * | 10/2013 | Park | B25B 5/101 269/214 |
| 8,991,024 | B2 * | 3/2015 | Barillaro | B25B 5/101 269/140 |

* cited by examiner

CLAMPING TOOL

CROSS-REFERENCE TO RELATED APPLICATION DATA

Priority is claimed under 35 U.S.C. § 119(e) to U.S. Provisional Application No. 62/388,770, filed on Feb. 8, 2016, which is incorporated by reference herein.

FIELD OF THE INVENTION

The present invention generally relates to hand tools and more specifically to tools used to clamp or press a workpiece such as a portion of an automobile body.

BACKGROUND OF THE INVENTION

Clamping a workpiece may be necessary to hold the workpiece so that additional work may be done on the item or in some cases the process of clamping the workpiece may be the end process. Such may be the case with a piece of sheet metal or similar item that has become dented or otherwise deformed. Applying a steady and substantially high compressive force to the item may remove the dent of deformity. The use of dies may be used to concentrate the clamping force in specific areas. This process may be used to remove dents and body damage in automobiles.

Automobiles and other vehicle bodies are typically constructed of sheet metal or other pliable materials. In some cases the body of a vehicle is as important to the owner of the vehicle as is the engine and drive train, which makes the vehicle function to move from place to place. The precise cleans lines of a vehicle body may signify beauty and stature but also a well kept automobile may make a positive statement about the driver to all that pass by. Ironically, the body of a vehicle may be exposed to countless hazards on a regular basis. These may come in the form of rocks and other road debris thrown up from other vehicles on the road, weather related objects such as hail and inconsiderate or inattentive other drivers and pedestrians, such as a door ding in a parking lot. The physical beauty of the movable sculpture called an automobile may be soiled by a single dent in the otherwise pristine surface of the auto body.

An industry referred to as paintless dent removal was created from the need to remove dents and dings from automobile bodies without the need to repaint the vehicle. The durability of the paint on an automobile body may allow from some deformation and return of the underlying material to its original shape without the need to repaint the vehicle. In many cases this may provide a cost effective alternative to the filler, sanding and repainting process to repair a blemish of a vehicle body.

It should, therefore, be appreciated that there is a need for clamping tools that allow for repair of damage to pliable materials including a vehicle body. The present invention fulfills this need and others.

SUMMARY OF THE INVENTION

The present invention provides a clamping tool including a tool body with a first body member disposed opposite to a second body member, the first body member and the second body member connected by a base member. This may also be referred to as a C-shaped body. The first body member may include two or more non-collinear backstop bushings. A first backstop may be provided which may include a backstop pin releasably coupled to the first body member and received by one of the two or more non-collinear backstop bushings of the first body member. A drive screw assembly may be received by the second body member. The drive screw assembly may be coupled to a second backstop on a first end of the drive screw assembly and may include a handle on a second end of the drive screw assembly. Thereby, as the drive screw assembly is advanced relative to the second body member, the second backstop may be displaced relative to the first backstop. The second body member may include two or more non-collinear screw receivers so that the screw assembly may be positioned in more than one position on the second body member.

A drive screw of the drive screw assembly may mate with one of the two or more non-collinear screw receivers. The drive screw assembly may further include a pair of guide pins. The second body member of the tool body may likewise include at least one pair of guide pin bushings, whereby the pair of guide pins of the drive screw assembly may be received by the at least one pair of guide pin bushings. The pair of guide pins may be substantially parallel to one another. The guide pins may be shorter in length than the space between the first body member and the second body member of the tool body.

The first backstop or the second backstop may include a receiver section which may be configured to receive and support a removable tool die. The removable tool die may be comprised of a block with a rib received and supported by the receiver section of the removable tool die, the rib may also include a detent notch. The removable tool die may be an adjustable foot stop comprised of a longitudinal frame with a cavity supporting a clip, the clip being able to move within the cavity and a foot releasably coupled to the clip. When the foot is rigidly secured to the clip, the clip may be securely positioned at a location within the cavity of the longitudinal frame.

The first backstop may be comprised of a tool tip receiver, the tool tip receiver may be configured to receive and support a substantially round tool tip. The clamping tool may also include a detent spring plunger coupled to the first body member adjacent to one of the two or more non-collinear backstop bushings of the tool body. A detent ball of the detent spring plunger may be received by a recess in the backstop pin of the first backstop, whereby the detent ball may releasably secure the first backstop to the first body member of the base member of the tool body.

The drive screw assembly of the clamping tool may also include a drive screw with a spherical rod end which may be releasably received by a ball receiver mounted to the second backstop. When the spherical rod end of the drive screw is forcibly pressed into the ball receiver, the second backstop may be releasably coupled to the drive screw. The ball receiver may be constructed of a pliable material with a modulus of elasticity between 1.0 and 20.0 GPa ($10^9$ Pascal to $20\times10^9$ Pascal).

The drive screw assembly may include a handle. The handle of the drive screw assembly may be removable from the drive screw assembly.

For purposes of summarizing the invention and the advantages achieved over the prior art, certain advantages of the invention have been described herein above. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment(s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 1:
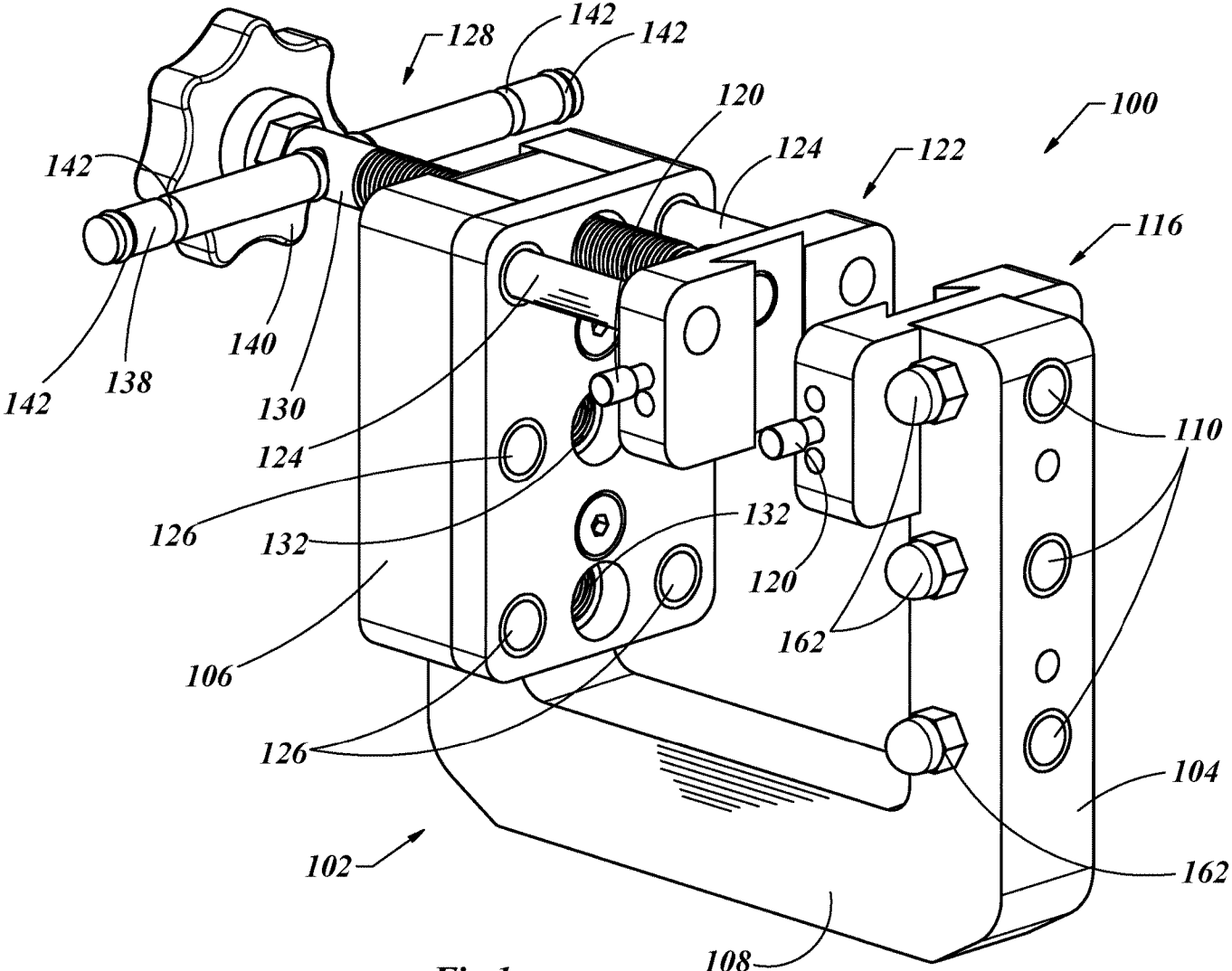
FIG. 1 is an isometric view of a clamping tool incorporating produced in accordance with the present invention.

With reference to the illustrative drawings, and particularly to FIGS. 1-5, there is shown a clamping tool 100. The clamping tool 100 may include a tool body 102 with a first body member 104 opposite to a second body member 106. A base member 108 may connect the first body member 104 with the second body member 106 together which, in this embodiment, may form a substantially C-shaped tool body 102. An advantage to the tool body 102, as shown in this embodiment, may be the open accessibility to the tool body from the side opposite to the base member 108. This will become clearer to the reader later in the disclosure.

The first body member 104 of the clamping tool 100 may also include two or more backstop bushings 110. In this embodiment there are shown three backstop bushings 110. The backstop bushings 110 may be arranged in a non-collinear orientation, such as shown here as all three backstop bushings 110 are arranged somewhat equidistant and spacing along a long dimension of the first body member 104. The backstop bushing 110 may be used to receive a backstop pin 112 extending from a back surface 114 of the first backstop 116. A cutout 118 may be provided in the back surface 114 of the first backstop 116, wherein the cutout 118 may be received by a portion of the first body member 104. In this manner, the backstop pin 112 may be received by any one of the backstop bushings 110 while the cutout 118 of the back surface 114 of the first backstop 112 may be supported by a portion of the first body member 104. This combination may allow the first backstop 116 to be positioned in more than one location on the tool body 102 while the interface between the cutout 118 in the first body member 104 may prevent the first backstop 116 from rotating about the backstop pin 112.

The first backstop 116 may be oriented such that a die screw 120 may be on the right side or left side of the tool body 112. The backstop pin 112 is not located in the geographical center of the first backstop 116. As shown here, the backstop pin 112 may be positioned closer to a top or bottom edge of the first backstop 116. This may have advantages in that the location of the first backstop 116 may be moved relative to the base member 108 of the tool body 102 by rotating the first backstop 116 about the backstop pin 112 when it is received by any one of the backstop bushings 110. This may provide additional adjustment of the first backstop 116 position on the tool body 102.

Opposite to the first backstop 116 may be provided a second backstop 122 the second backstop 122 may include a pair of guide pins 124 which may be received by a corresponding pair of guide pin bushings 126 in the second body member 106 of the tool body 102. A drive screw assembly 128 may also be received by the second body member 106 of the tool body 102. The drive screw assembly 128 may be comprised of a drive screw 130, which may be received by one of one or more screw receivers 132. The drive screw 130 may include a threaded portion 134, which may be in mechanical communication with a mating threaded portion 136 of each screw receiver 132. This combination may allow the drive screw assembly 128 to advance toward or away from the first body member 104 of the tool body 102 by rotation of the drive screw 130 in a clockwise or counterclockwise direction respectively.

To facilitate the process of rotating the drive screw 130 of the drive screw assembly 128, a handle rod 138 may be received by the drive screw 130 near a distal end thereof. In addition, a thumb screw knob 140 may be secured to the drive screw 130 near a distal end of the drive screw 130. In the event that the clamping tool 100 is in a position where the space available to rotate the drive screw 130 is limited by the handle rod 138, the handle rod 138 may be removable from the drive screw 130.

In this embodiment, the handle rod 138 may include a plurality of handle rings 142. The handle rings 142 may be constructed of a pliable material such as rubber and the outer surface of the handle rings 142 may extend beyond the outside diameter of the handle rod 138. The outer surface of the handle rings 142 may provide a slight amount of interference with the handle hole 144 in the drive screw 130, into which the handle rod 138 may be inserted. The interference between the handle ring 142 and the handle hole 144 may be overcome by providing a reasonable amount of force along the long axis of the handle rod 138. This may allow the handle rod 138 to extend more or less out of one side of the handle hole 144 or be removed completely from the drive screw 130 as needed by the user.

The drive screw 130 of the drive screw assembly 128 may include a spherical rod end 146 on a portion of the drive screw 130 opposite the thumb screw knob 140. The spherical rod end 146 may be received by a ball receiver 148 coupled to the second backstop 122. The outside diameter of the spherical rod end 146 may be slightly larger than an opening 150 of a cavity 152 provided within the ball receiver 148. The ball receiver 148 may optimally be manufactured of a pliable material with elastic properties such as a plastic. This may allow the spherical rod end 146 of the drive screw 130 to be repeatedly coupled to the ball receiver 148 and removed from the ball receiver 148.

The guide pins 124 of the second backstop 122 may be received by a pair of guide pin bushings 126 located in the second body member 106 of the tool body 102, and adjacent to the drive screw 130. If the drive screw 130 is rotated in a counterclockwise direction, the spherical rod end 146 of the drive screw 130 may be displaced farther from the first body member 104. This may draw the second backstop 122 away from the first body member 104 in a manner consistent with the movement of the drive screw 130 in that the spherical rod end 146 may be received by the cavity 152 within the ball receiver 148. The second backstop 122 may then be moved away from the first body member 104 until the second backstop 122 make contact with the second body member 106. At this point the second backstop 122 may no longer be able to move further away from the first body member 104. If the drive screw 130 continues to advanced in a counterclockwise direction, thus displacing it further from the first body member 104, the spherical rod end 146 may be displaced from the cavity 152 by temporarily deforming the opening 150 of the ball receiver 148, thus allowing the spherical rod end 146 to be removed from the ball receiver 148. This may allow the drive screw assembly 128 to continue to advanced away from the first body member 104 such that the drive screw 130 is no longer received by the screw receiver 132.

If the drive screw assembly 128 is removed from the second backstop 122 the use may be remove from the second body member 106 from the tool body 102 by sliding it toward the first body member 104. The length of the guide pins 124 may be shorter in length than the space between the first body member 104 and the second body member 106. Therefore the second body member may now be removed from the tool body 102 and be positioned in a different location by aligning the guide pins 124 with a different pair of guide pin bushings 126. The drive screw assembly 128 may then be repositioned and inserted into the screw receiver 132 adjacent to the new location of the guide pins 124 of the second backstop 122. The drive screw 130 may then be advanced in a clockwise direction, thus advancing the spherical rod end 146 toward the first body member 104. As this happens, the repositioned second backstop 122 may then be advanced also toward the first body member 104. By positioning a block between the second backstop 122 and the first body member 104, the position of the second backstop 122 may be held in place relative to the tool body 102. As the drive screw 130 continues to advance by continuing to rotate the drive screw 130 in a clockwise direction, the spherical rod end 146 may apply enough pressure to the opening 150 of the ball receiver 148 such as to allow the opening 152 to temporarily increase in diameter so the spherical rod end 146 may pass into the cavity 152 of the ball receiver 148, thus coupling the drive screw 130 to the second backstop 122.

Figures 2, 3:
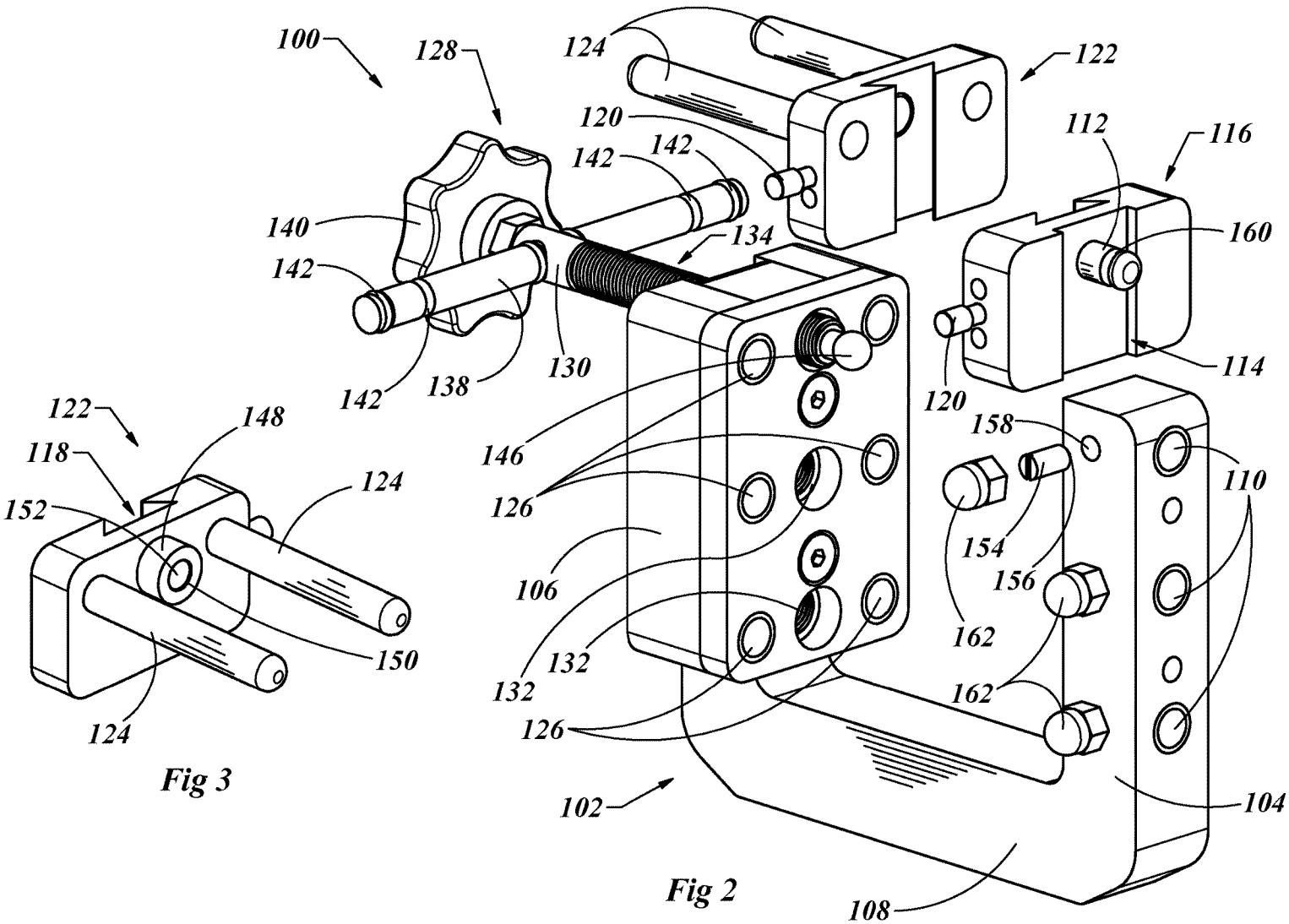
FIG. 2 is an isometric view of the clamping tool of FIG. 1 with the first and second backstops displaced from the tool body.
FIG. 3 is an isometric view of the second backstop and the guide pins in FIG. 2 shown from the opposite direction of that in FIG. 2.
Figure 4:
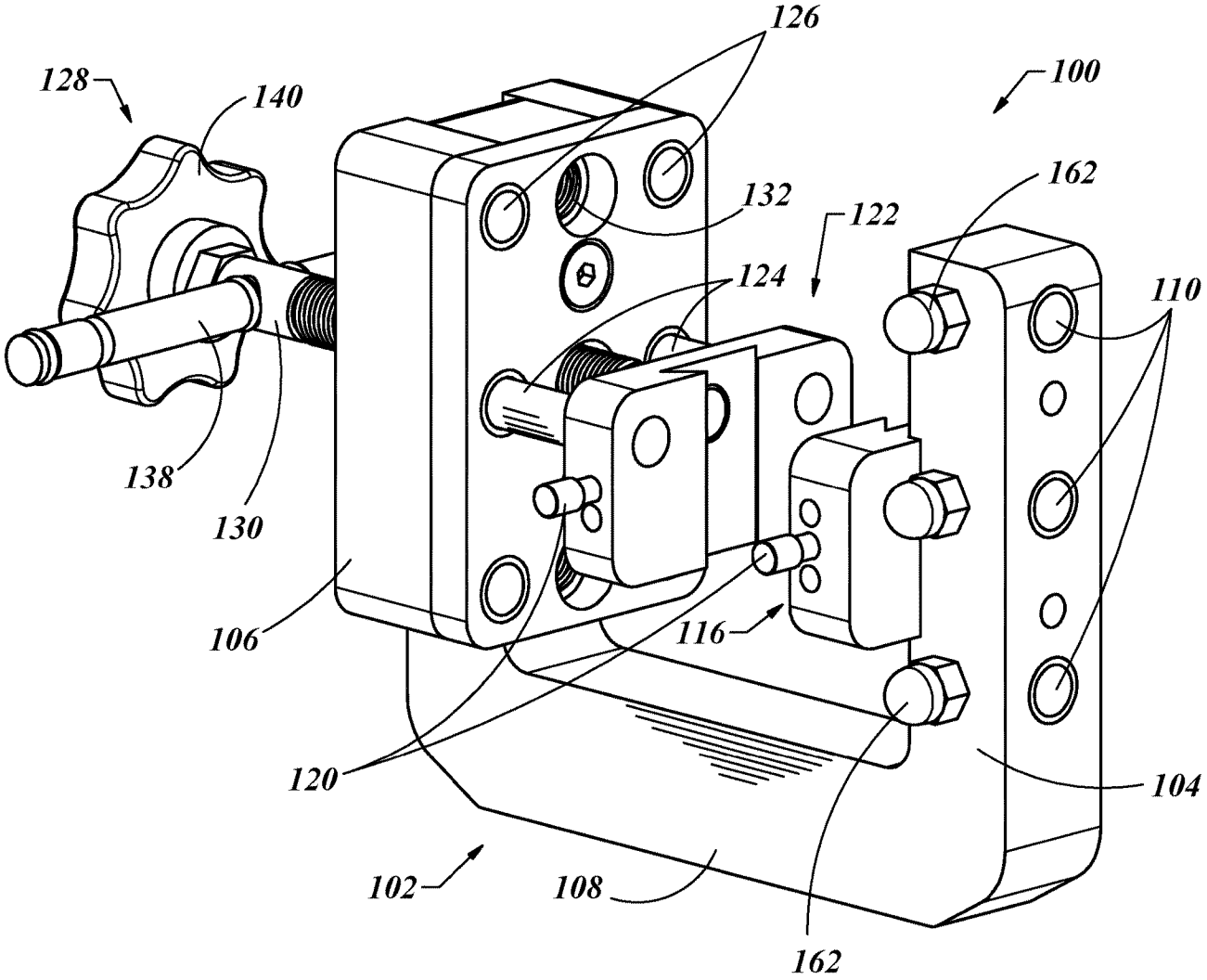
FIG. 4 is an isometric view of the clamping tool of FIG. 1 with the first and second backstops in a middle position on the tool body.
Figure 5:
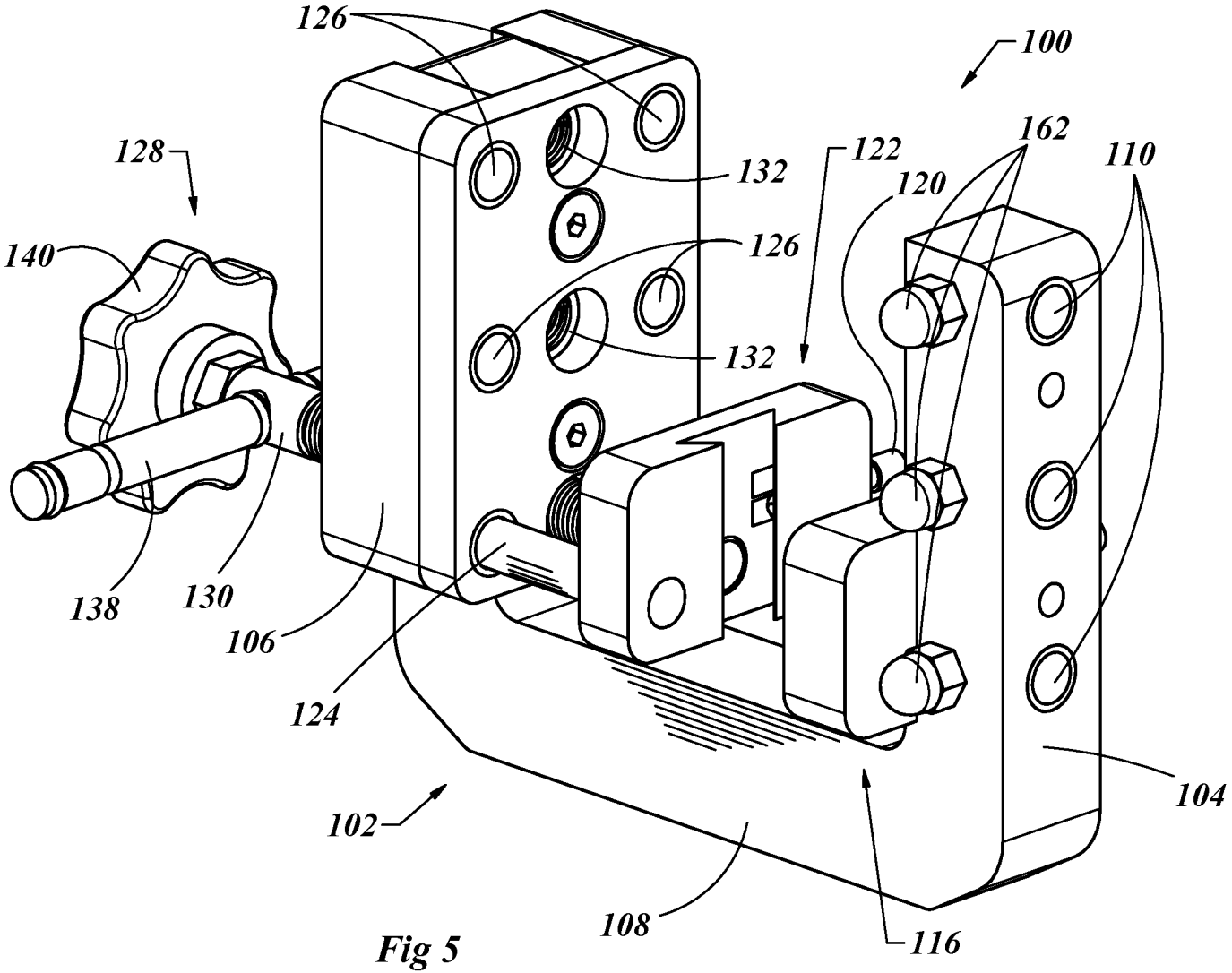
FIG. 5 is an isometric view of the clamping tool of FIG. 1 with the first and second backstops in a lower position on the tool body.

To provide proper coupling as yet allow the necessary deformation to join and disjoin the spherical rod end 146 with the ball receiver 148, it is suggested that the material composition of the ball receiver 148 have a modulus of elasticity of between 1.0 and 20.0 GPa. The elastic properties of the ball receiver 148 may allow the necessary deformation of the opening 150 of the ball receiver 148 to receive and remove the spherical rod end 146 of the drive screw 130 while allowing the opening 150 of the ball receiver 148 to spring back to its original dimension, thereby coupling the second backstop 122 to the drive screw 130 when assembled together. The clamping tool 100 shown with the first backstop 116 and the second backstop in the top, middle and lower positions are shown in FIGS. 1, 3 and 4 respectively.

As is shown in these figures, the first backstop 116 may be positioned in any of the backstop bushings 110 by inserting the backstop pin 112 into any of the backstop bushings 110. To help hold the first backstop 116 in a position with respect to the first body member 104 of the tool body 102, a detent spring 154 that may include a detent ball 156 on one end may be provided. The detent spring 154 may be screwed into the side of the first body member 104 of the tool body 102 through an access hole 158. The detent spring 154 may be advanced into the access hole 158 until the detent ball 156 is received by a recess 160 in the backstop pin 112 of the first backstop 116. When the first backstop 116 is inserted into the backstop bushing 110, the end of the backstop pin 112 may make contact with the detent ball 156 of the detent spring 154. The user may then apply some force to push the first backstop 116 farther toward the first body member 104 of the tool body 102. This force may displace the detent ball 156 of the detent spring 154, thereby allowing the backstop pin 112 to advance and the first backstop 116 to seat against the first body member 104. At that position the detent ball 156 of the detent spring 154 may be received by the recess 160 in the backstop pin 112, thereby releasably locking the first backstop 116 to the tool body 102 while nested into the first body member 104. An acorn nut 162 may be used to screw onto the exposed portion of the detent spring 154, thereby locking it in place relative to the tool body 102.

Figure 6:
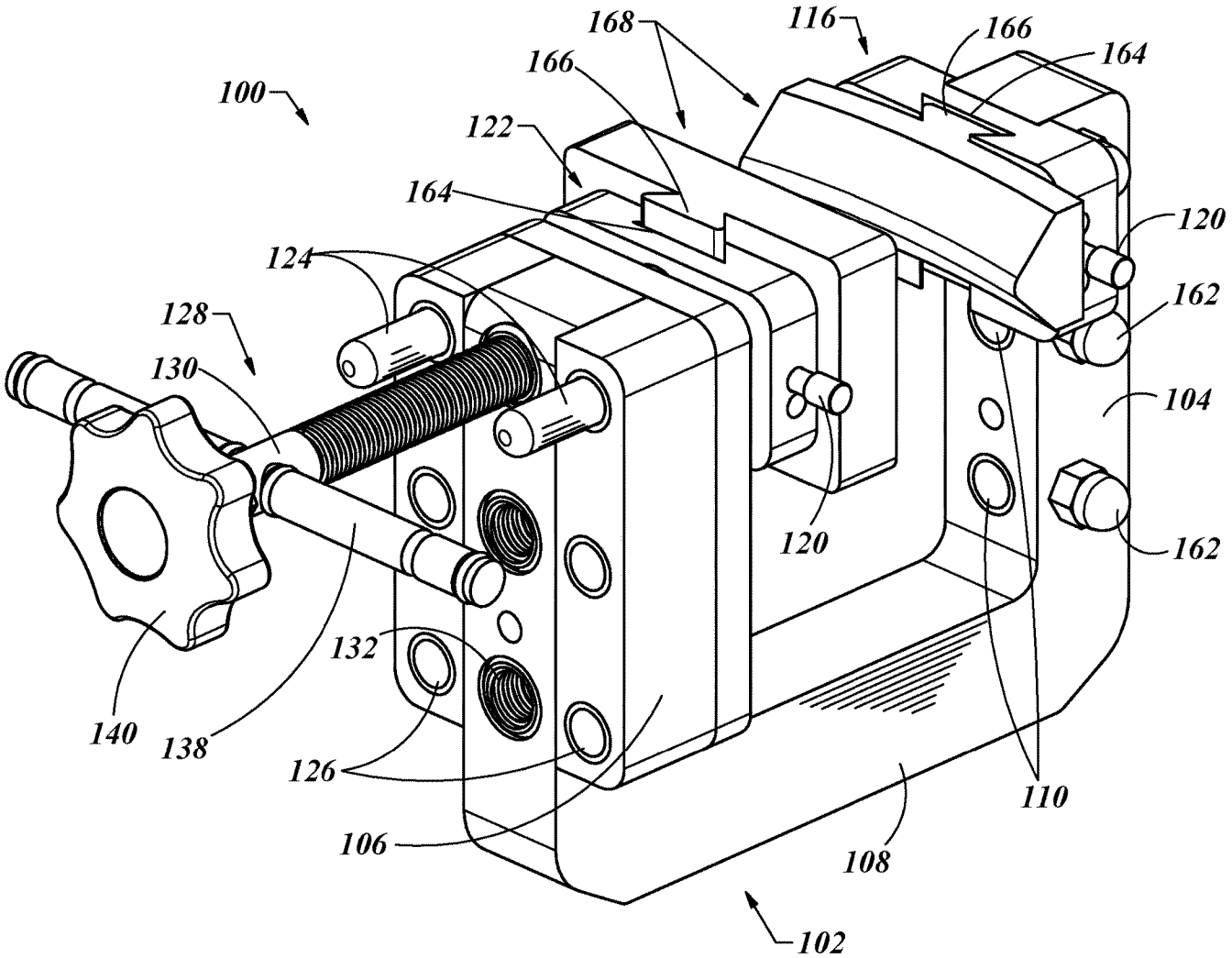
FIG. 6 is an isometric view of the clamping tool of FIG. 1 with a pair of tool dies received by the first backstop and the second backstop.
Figure 7:
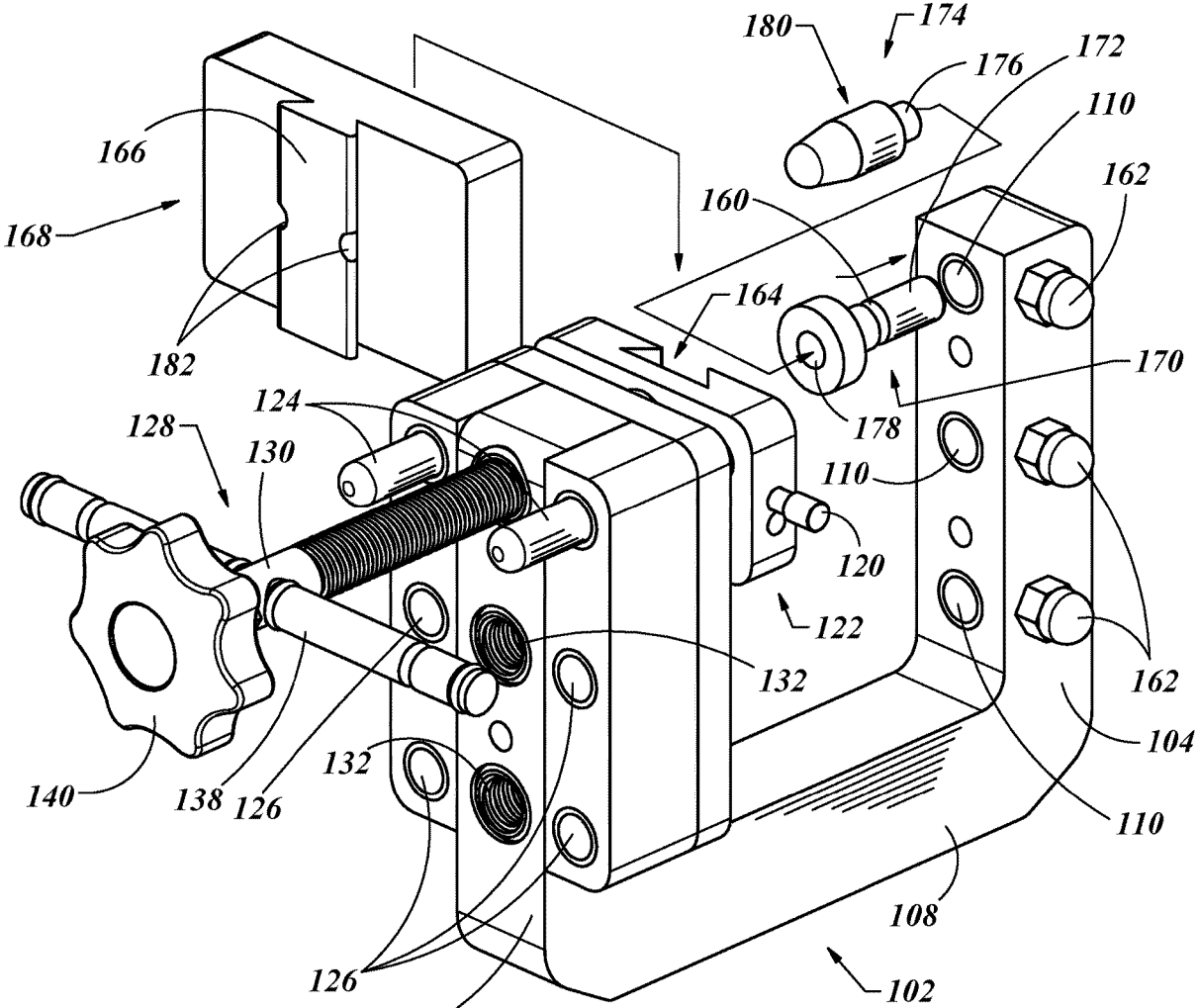
FIG. 7 is an isometric view of the clamping tool of FIG. 6 with a tool die displaced from the second backstop, the first backstop in the form of a tool tip receiver and a tool tip displaced from the tool tip receiver.
Figure 8:
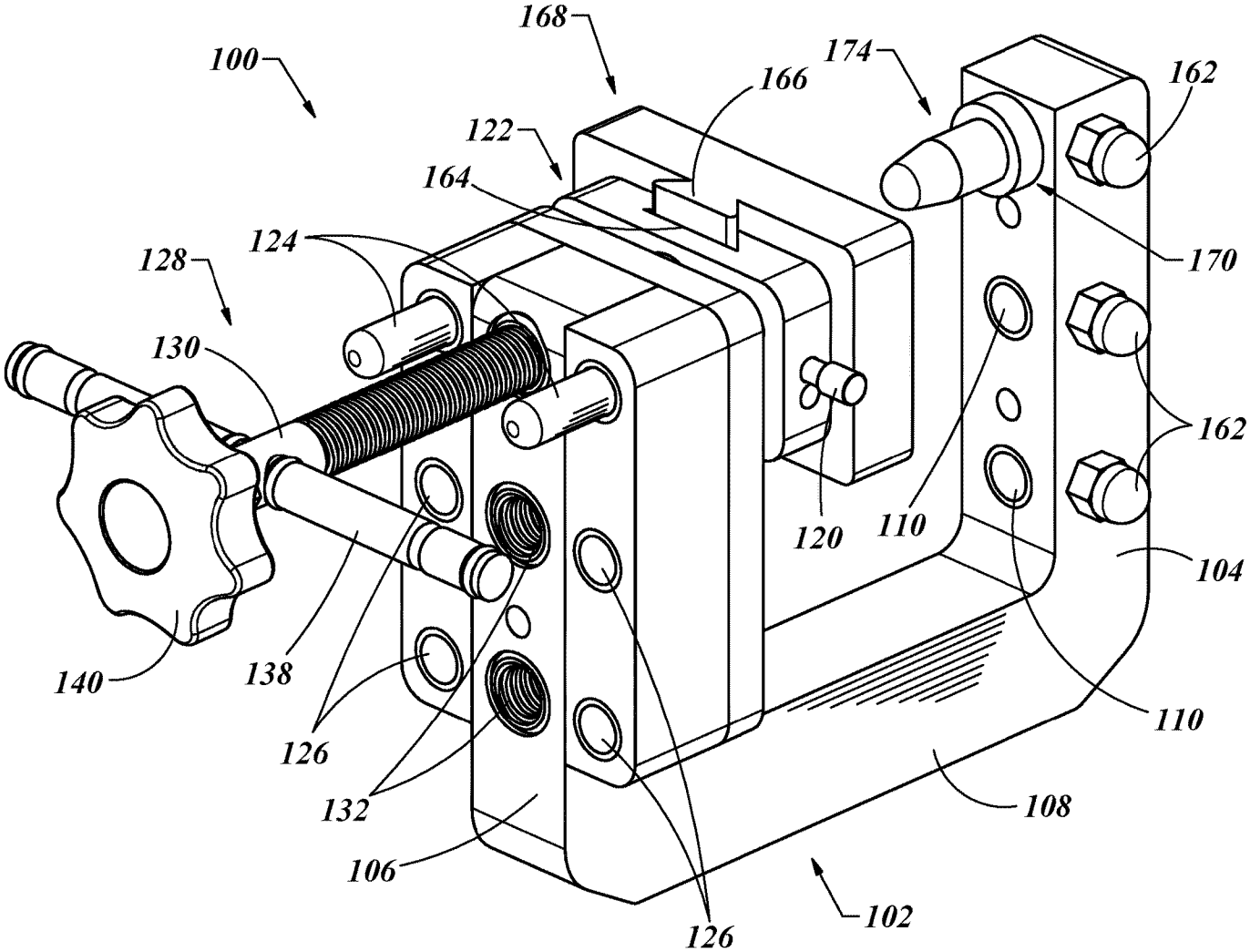
FIG. 8 is an isometric view of the clamping tool of FIG. 7 with the tool die received by the second backstop, the tool tip receiver positioned in the tool body with a tool tip in the tool tip receiver.

With reference to FIGS. 6-8, the first backstop 116 and the second backstop 122 of the clamping tool 100 may both include a receiver section 164. The receiver section 164 may be in the form of a tail of a dovetail joint, which may be adapted to receive a dovetail pin or rib 166 of a removable tool die 168. In FIG. 6 in example of the clamping tool 100 is shown as it may be used with a removable tool die 168 coupled to the first backstop 116 by inserting the rib 166 of the removable tool die 168 into the receiver section 164. The removable tool die 168 may be secured to the first backstop 116 by advancing the die screw 120 farther into the first backstop 116 so that a distal end of the die screw 120 makes contact with the removable tool die 168. A similar arrangement may be used on the second backstop 122, wherein another removable tool die 168, which may include a rib 166, may be received by a receiver section 164 and the second backstop 122. A variety of removal tool dies 168 may be used with either the first backstop 116, the second backstop 122, or both. The choice of the size and shape of the removable tool dies 168 may be up to the individual user and may be based on the shape and dimension of a workpiece which needs to be manipulated. In a similar manner, either removable tool die 168 may be moved closer to the base member 108 of the tool body 102 by moving the first backstop 116 or the second backstop 122 into a different position on the first body member 104 and the second body member 106 respectively, as previously disclosed.

A typical use of the clamping tool 100 as shown may be to place a workpiece between the two removable tool dies 168 and then advancing the drive screw assembly 128 in a clockwise direction so as to decrease the space between the two removable tool dies 168. A compression force may then be applied to workpiece to alter its shape. This may be desirable in any number of situations including sheet metal work in general as well as in paintless dent removal of automobile bodies. The versatility of being able to adjust the position of one or both removable tool dies 168 with relation to the physical parameters of the tool body 102 may allow a user to position the removable tool dies 168 in a precise position while avoiding other structures and portions of the automobile body or other potential obstructions. The use of a screw mechanism, as may be found in the drive screw assembly 128, allows the user to apply a significant amount of force to the workpiece in a precise area on the workpiece.

In FIG. 7 a removable tool die 168 is shown as displaced from the second backstop 122 and the first backstop 116 is shown in the form of a tooltip receiver 170. The tooltip receiver 170 version of the first backstop 116 may include a cylindrical portion 172 and a recess 160. The recess 160 may articulate with the detent spring 154 located under the acorn nut 162 as previously disclosed, such that the tooltip receiver 170 may be inserted into a backstop bushing 110 and releasably secured to the first body member 104. A tooltip 174 may include a tip stud 176, which may be received by a tooltip receiver cavity 178. The tool tip body 180 may then extend beyond the surface of the tool tip receiver 170.

Additional detail of the removable tool die 168 is shown in a preferred embodiment as displaced from the tool body 102 in FIG. 7. A detent notch 182 may be provided on one or both sides of the rib 166 of the removable tool die 168. The detent notch 182 may provide a positive location for contact with the die screw 120. The distal end of the die screw 120 may be received by the physical indent of the detent notch 182, further securing the removable tool die 168 in a set position relative to the first backstop 116 or the second backstop 122. The combination when assembled may take the form of that as shown in FIG. 8.

Figure 11:
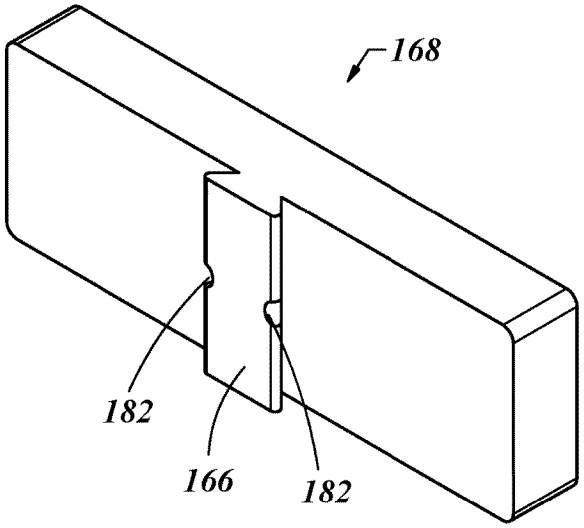
FIG. 11 is an isometric view of an elongated rectangular tool die.
Figure 10:
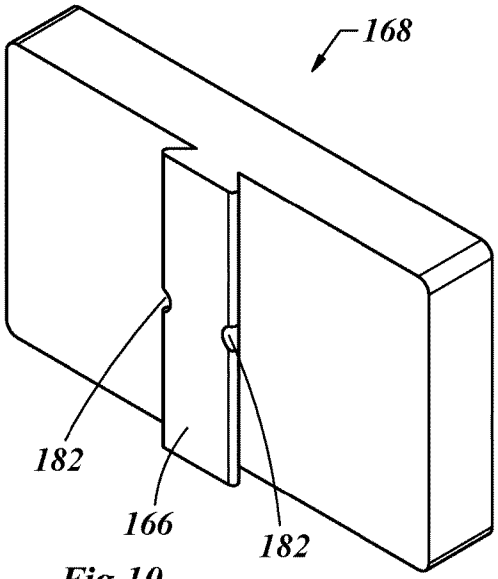
FIG. 10 is an isometric view of a midsized rectangular tool die.
Figure 9:
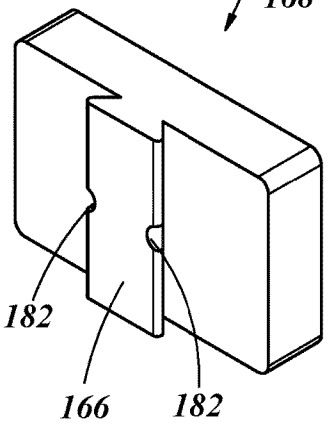
FIG. 9 is an isometric view of a short rectangular tool die as shown in FIG. 8.

With reference to FIGS. 9-11 a variety of substantially rectangular removable tool dies 168 are shown. In this embodiment each removable tool die 168 may include a rib 166 with at least one detent notch 182 on one side of the rib 166.

Figure 12C:
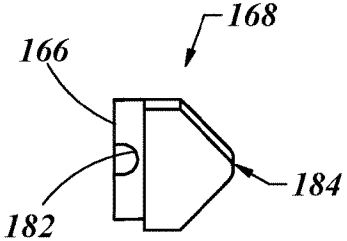
FIG. 12C is a side view of the tool die shown in FIG. 12A.
Figure 12B:
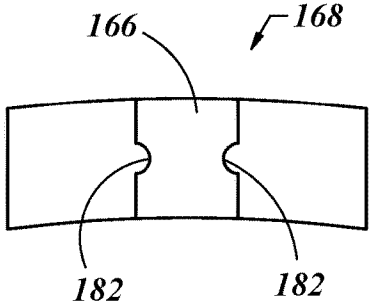
FIG. 12B is a rear view of the tool die shown in FIG. 12A.
Figure 12A:
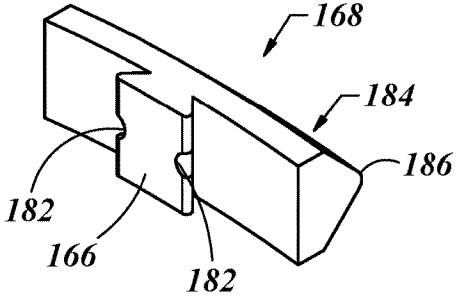
FIG. 12A is an isometric view of an arched, conical tipped, elongated tool die.
Figure 15:
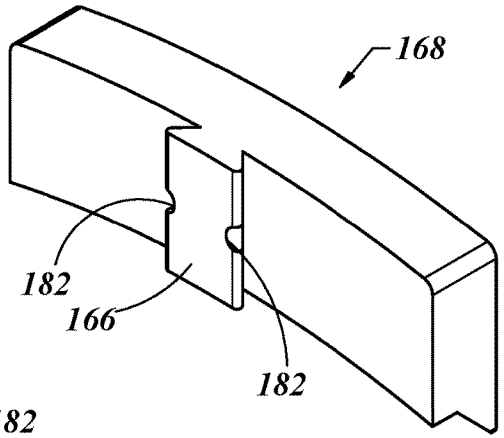
FIG. 15 is an isometric view of a tool die with an arched front and a bottom lip.
Figure 14:
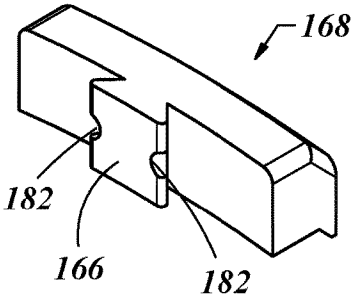
FIG. 14 is an isometric view of a tool die with curved and lip edges.
Figure 13:
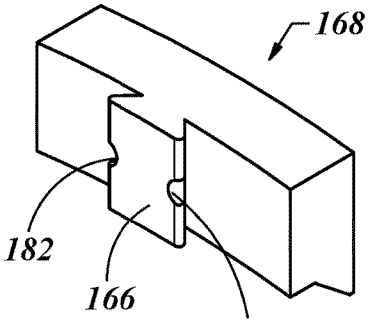
FIG. 13 is an isometric view of a tool die with an edge lip.

With reference to FIGS. 12*a*-12*c*, a removable tool die 168 is shown with an arcuate bar and a conical tip 184. The conical tip 184 may include a radiused edge 186 that may contact the workpiece to apply a significant amount of pressure to a portion of the workpiece without creating an excessively high stress point as may be with a sharp edge. Such a combination may allow a workpiece to be manipulated and not disturb a painted surface of the workpiece.

As is shown in FIGS. 13-16 a variety of other examples of removable tool dies 168 are provided. Each of these removable tool dies 168 may include a rib 166 and a detent notch 182. In all embodiments shown, there may be two detent notches 182 positioned on opposite sides of the rib 166, thereby allowing the removable tool die 168 to be positioned with either side toward the die screw 120, as previously shown and described.

Figure 17:
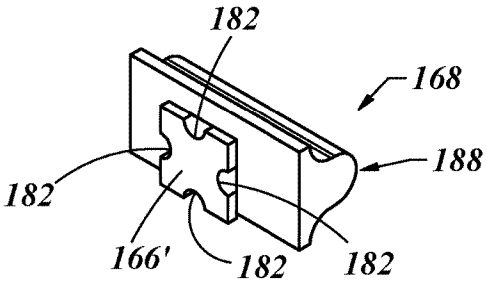
FIG. 17 is an isometric view of a tool die with a short elongated circular tip.
Figure 16:
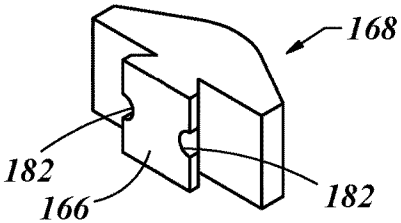
FIG. 16 is an isometric view of a tool die with a short conical tip.
Figure 18C:
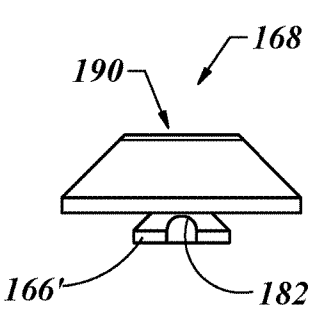
FIG. 18C is a front view of the tool die shown in FIG. 18A.
Figure 18B:
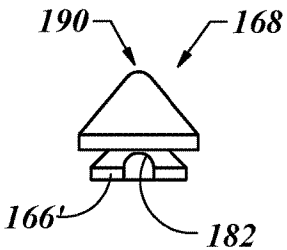
FIG. 18B is a side view of the tool die shown in FIG. 18A.
Figure 18A:
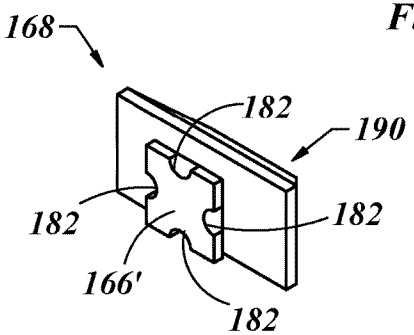
FIG. 18A is an isometric view of a tool die with a duel tapered tip.

Another variation to the removable tool dies 168 is shown in FIGS. 17-18*c*. Here a short elongated circular tip 188 is shown in FIG. 17 and a duel tapered tip 190 is shown in FIGS. 18*a*-18*c*. Each tool tip may have certain advantages depending on the shape of the workpiece to be manipulated and the space required to access that portion of the workpiece. With removable tool dies 168 that are shorter in length, it may be desirable to have a square rib 166' so that the removable tool die 168 may be positioned vertically or horizontally in the first backstop 116 or second backstop 122 of the clamping tool 100. These additional positioning options of the removable tool die 168 in the clamping tool 100 may enable a user to access different locations on a workpiece that may not be possible otherwise. With the use of the square rib 166', a detent notch 182 may be positioned on each of the four sides of the square rib 166' so as to allow accessibility to the die screw 120 in any position.

Figure 21:
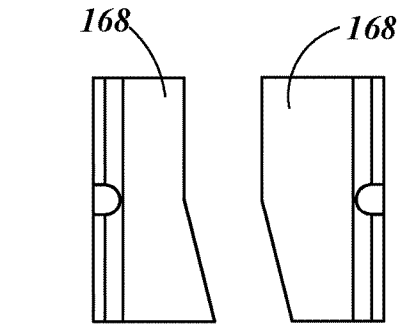
FIG. 21 is a side view of the tool die pair as shown in FIGS. 19 and 20.
Figure 24:
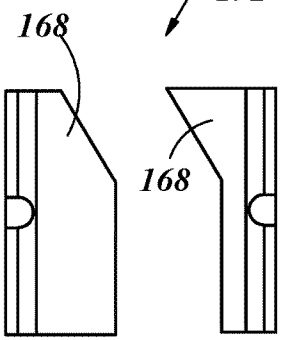
FIG. 24 is an isometric view of a tool die pair as shown in FIGS. 22 and 23.
Figure 20:
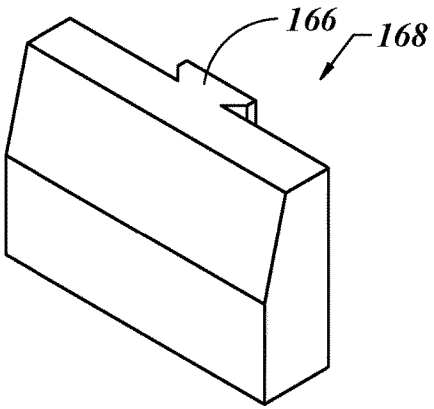
FIG. 20 is an isometric view of a second portion of a tool die pair with a center edge.
Figure 23:
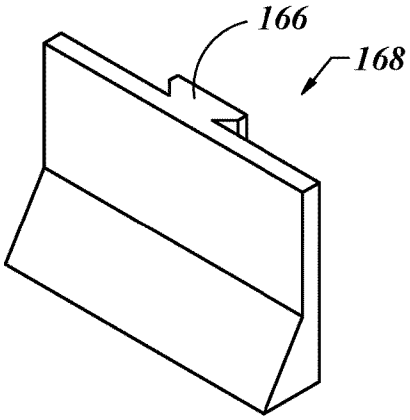
FIG. 23 is an isometric view of a second portion of a tool die pair with an offset center edge.
Figure 19:
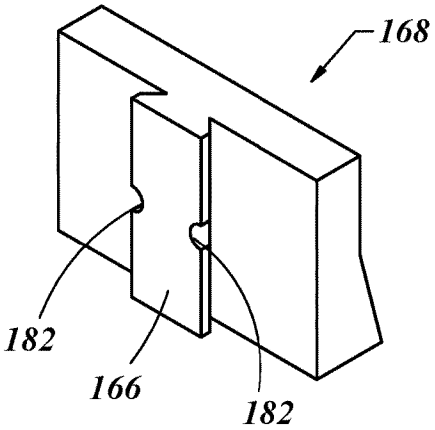
FIG. 19 is an isometric view of a first portion of a tool die pair with a center edge.
Figure 22:
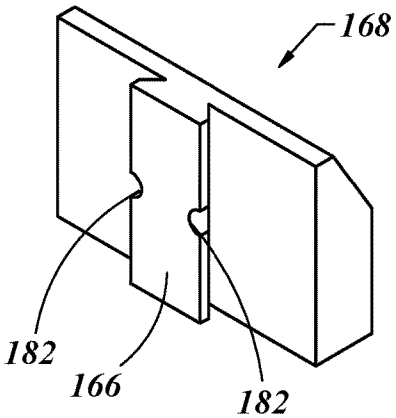
FIG. 22 is an isometric view of a first portion of a tool die pair with and offset center edge.
Figure 26:
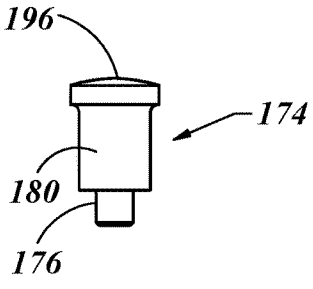
FIG. 26 is a side view of a tool tip with a small end flange.

A variety of mating tool die pairs may also be used. In FIGS. 19-20 each removable tool die 168 may be used in combination to make a mating tool die pair 192, as shown in FIG. 21. The tool die pair 192 may be used by placing one of each of these removable tool dies 168 in one of the first backstop 116 and the other in the second backstop 122 such that when viewed from the side the front surfaces of each removable tool die 168 come together to mate such that when contacted one to the other, each the front surfaces would match one another. This is shown in FIG. 21. Another variation is shown with the removable tool dies in FIGS. 22-23 and a side view of the front surfaces mating together in FIG. 24. The intended use may be to provide a workpiece between each removable tool die 168 of the mating tool die pair 192, so that when the removable tool dies 168 are pressed together by the clamping tool 100, the workpiece may conform to the shape of the removable tool dies 168.

Figure 25B:
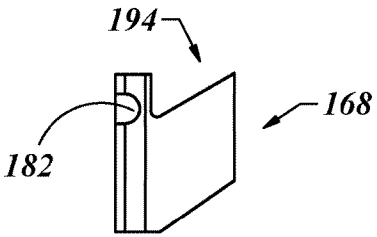
FIG. 25B is a side view of the tool die shown in FIG. 25A.
Figure 25A:
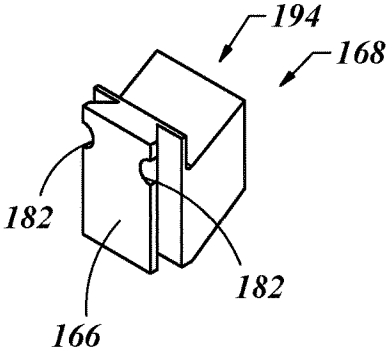
FIG. 25A is an isometric view of tool die with an angled extension.
Figure 28:
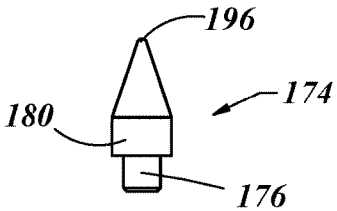
FIG. 28 is a side view of a tool tip with a sharp conical end.
Figure 27:
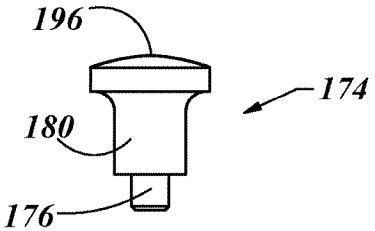
FIG. 27 is a side view of a tool tip with a large end flange.
Figure 31:
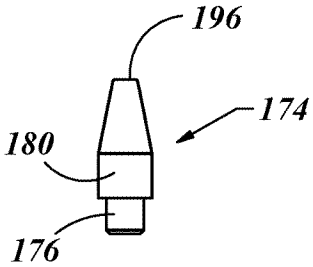
FIG. 31 is a side view of a tool tip with a small flat conical end.
Figure 30:
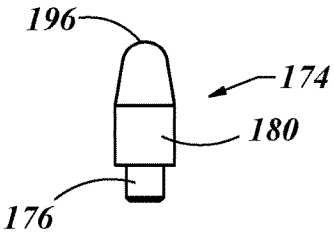
FIG. 30 is a side view of a tool tip with a large rounded conical end.
Figure 29:
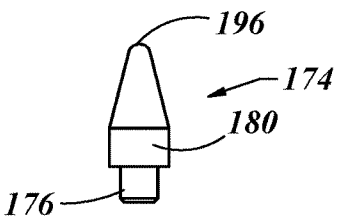
FIG. 29 is a side view of a tool tip with a medium rounded conical end.
Figure 32:
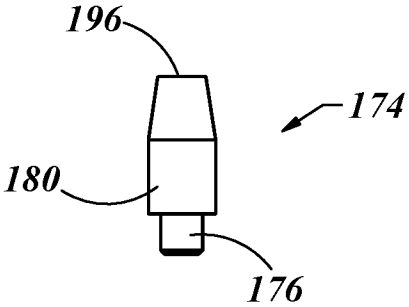
FIG. 32 is a side view of a tool tip with a large flat conical end.
Figure 33:
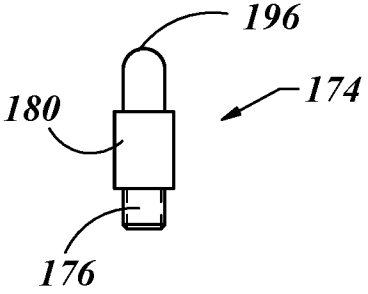
FIG. 33 is a side view of a tool tip with a rounded end.
Figure 34:
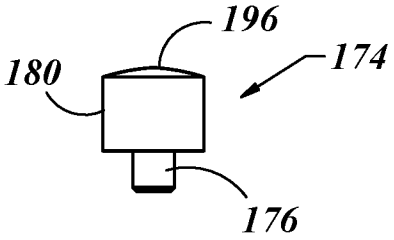
FIG. 34 is a side view of a tool tip with a large cylindrical body and a small curved end.
Figure 35:
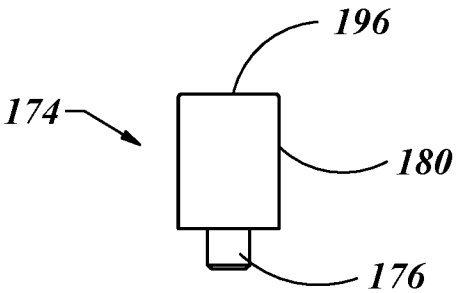
FIG. 35 is a side view of a tool tip with a large cylindrical body and a flat end.
Figure 36:
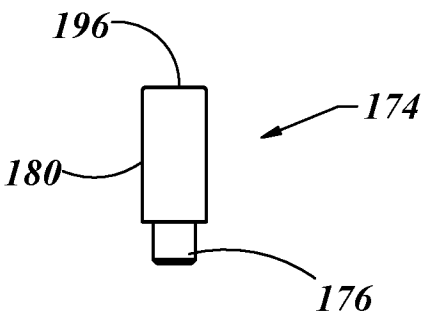
FIG. 36 is a side view of a tool tip with a small cylindrical body and a flat end.

In some cases a removable tool die 168 may be desired to have an angled extension 194 opposite to the rib 166, which as before, may include a detent notch 182. The purpose of the angled extension 194 may be to work around an existing element or formation in the workpiece and then be able to contact and manipulate a different portion of the workpiece. An example is shown in FIGS. 25*a*-25*b*.

Referring to FIGS. 26-36 a variety of designs of tool tips 174. Each tool tip 174 may include a tool tip body 180 and a tool tip stud 176. The tool tip stud 176 may be inserted into the tool tip receiver 170 as shown in FIG. 8. Each tool tip 174 may include a tip crown 196 that may be adapted to contact the workpiece. The shape, contour and dimension of each tip crown 196 may be important in the user's choice of the proper tool tip 174 needed to properly manipulate the workpiece in a desired manner with the use of the clamping tool 100.

Figure 38:
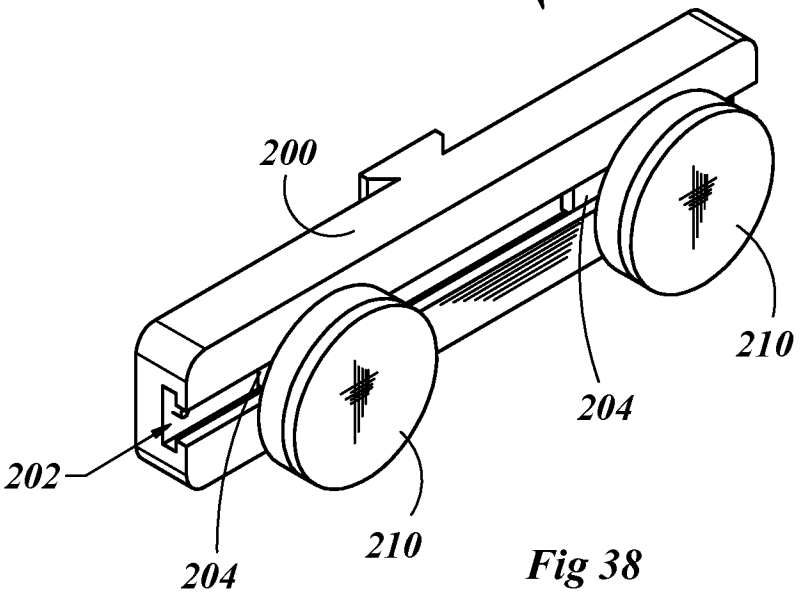
FIG. 38 is an isometric view of the adjustable foot stop shown in FIG. 37 shown assembled.
Figure 37:
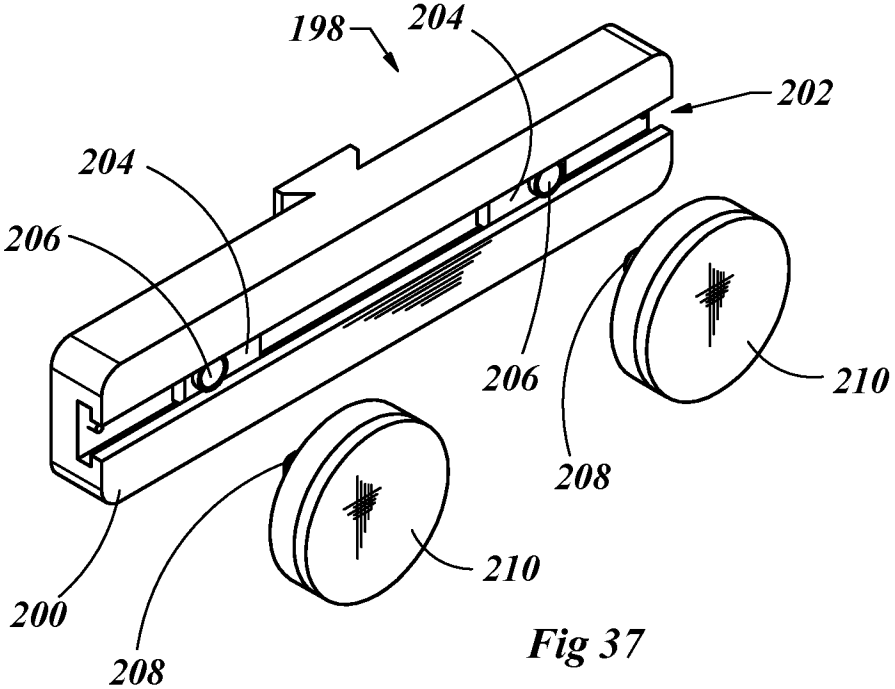
FIG. 37 is an isometric view of an adjustable foot stop with the feet displaced from the longitudinal frame.
Figure 39:
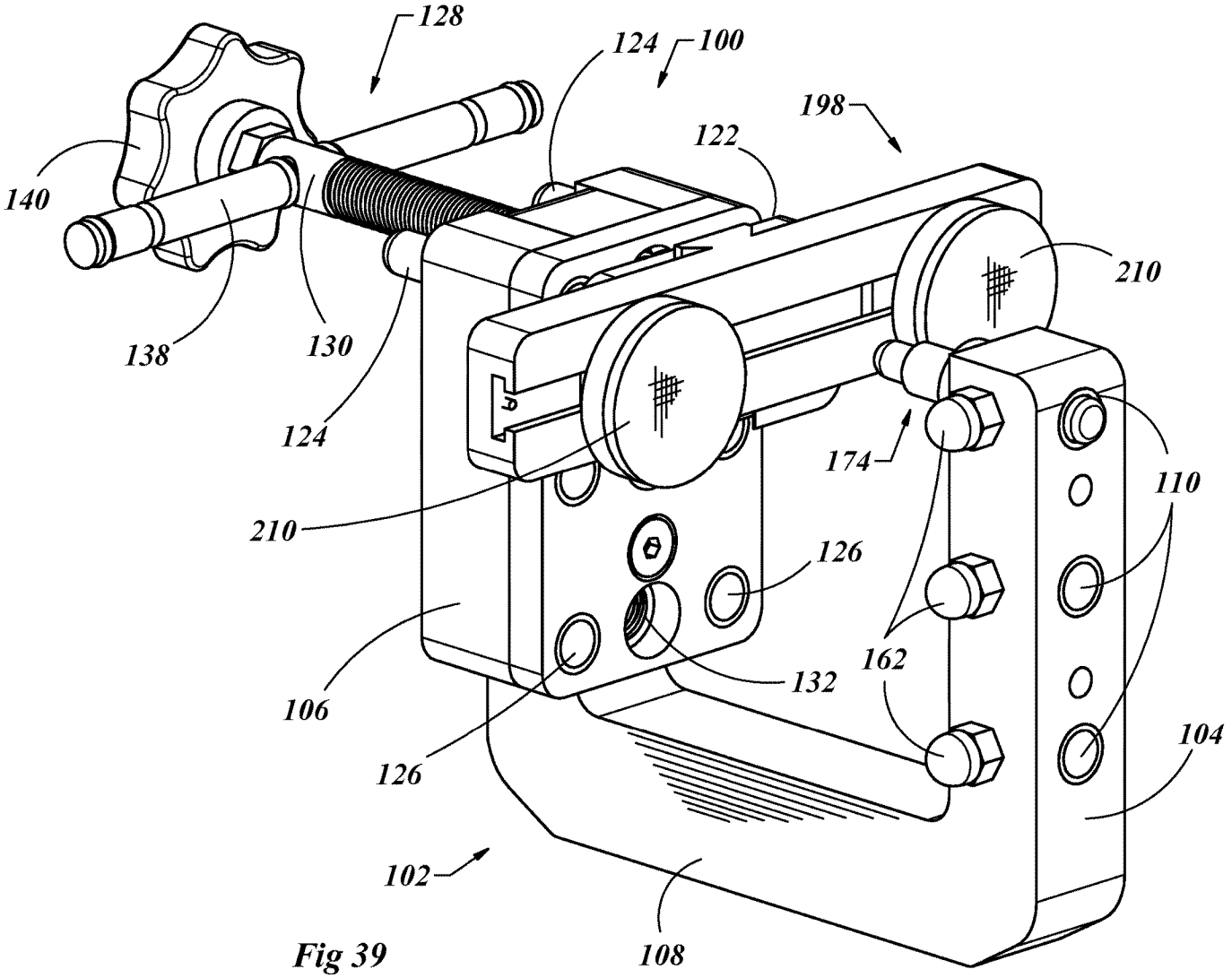
FIG. 39 is an isometric view of a clamping tool with a tool tip on a first end and an adjustable foot stop on a second end.

With reference to FIGS. 37-39, an adjustable foot stop 198 is shown in a disassembled, assembled state and also in use, with the clamping tool 100. FIG. 37 shows an adjustable foot stop 198 including a frame 200 with a central cavity 202. Inside the cavity 202 may be a pair of clips 204. These clips 204 may include a threaded portion 206 that may be adapted to receive a threaded stud 208 on one end of a foot 210. The clips 204 may move freely within the cavity 202 so that the clips 204 may be positioned anywhere within the cavity 202. A foot 210 may then be screwed into the threaded portion 206 of the clip 204 such that the threaded stud 208 of the foot 210 may pass through the clip 204 and contact the frame 200 on the back side of the cavity 202. This may allow the foot 210 to be securely fastened to the frame 200 at that position set by the clip 204. To move the foot 210, the user may slightly unscrew the foot 210 from the clip 202, thereby removing the contact between the threaded stud 208 and the back portion of the cavity 202, reposition the clip 204 with the foot 210 to a new location and screw the foot 210 back into the clip 204 until the threaded stud 208 again makes contact with the portion of the frame 200 beyond the cavity 202. The adjustable foot stop 198 is shown as assembled in FIG. 38.

The assembled adjustable foot stop 198 may be assembled into the first backstop 116 or, as shown in FIG. 39, into the second backstop 122. The feet 210 of the adjustable foot stop 198 used in the clamping tool 100 may provide a specific location of force application to a workpiece with a single tool, such as a tool tip 174 opposite to the adjustable foot stop 198. The feet 210 may also be manufactured of a pliable material such as a rubber, which may be more adapted to grip a smooth surface and not mark a painted surface. Any tool combination may be used with the adjustable foot stop 198 as the version shown in only one example.

Figure 41:
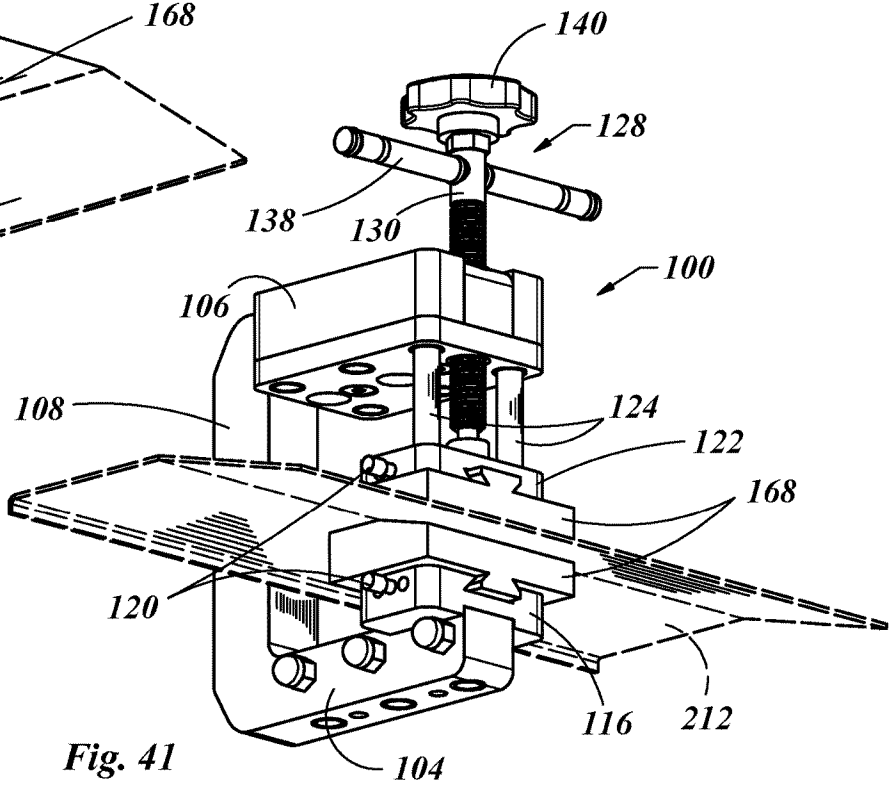
FIG. 41 is an isometric view of the clamping tool shown in FIG. 40 now shown in a front bottom view.
Figure 40:
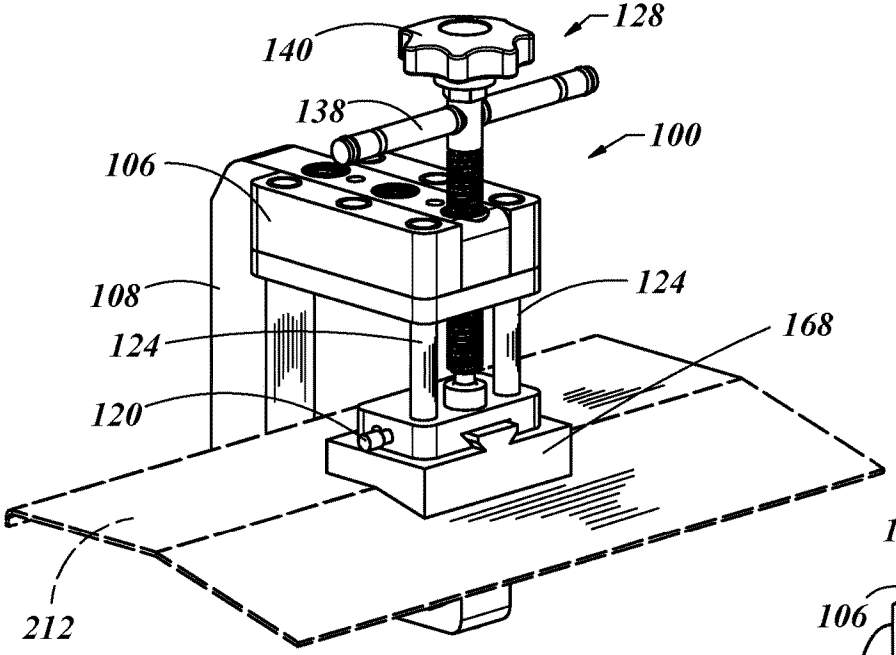
FIG. 40 is an isometric view of a clamping tool with a tool die pair and a workpiece in the clamping tool, shown in a front top view.

A typical use of the clamping tool 100 is shown in FIGS. 40-41. A workpiece 212 may be positioned between a pair of removable tool dies 168. Each of the two tool dies 168 may be coupled to one of the first backstop 116 and the second backstop 122 and secured in place by the die screws 120. The drive screw 130 may be advanced until the two removable tool dies 168 make firm contact with the workpiece 212, applying a force to the workpiece 212 such that a portion of the workpiece 212 may conform in shape to that of the removable tool dies 168. The workpiece 212 may then be repositioned within the clamping tool 100 and the process repeated with these or different removable tool dies 168, including tool tips 174 and the adjustable foot stop 198. The process, use of different tools and locations may be up to the user and the desired end result of changing the shape of the workpiece 212.

The foregoing detailed description of the present invention is provided for purposes of illustration, and it is not intended to be exhaustive or to limit the invention to the particular embodiment shown. The embodiments may provide different capabilities and benefits, depending on the configuration used to implement key features of the invention.

What is claimed is:

1. A clamping tool, comprising:

a tool body with a first body member disposed opposite to a second body member, the first body member and the second body member connected by a base member, the first body member further including two or more independent backstop bushings;

a first backstop including a backstop pin releasably coupled to the first body member and received by one of the two or more independent backstop bushings of the first body member; and;

a drive screw assembly received by the second body member, the drive screw assembly coupled to a second backstop on a first end of the drive screw assembly and a handle on a second end of the drive screw assembly, the second backstop including a pair of guide pins, whereby as the drive screw assembly is advanced relative to the second body member, the second backstop is displaced relative to the first backstop.

2. The clamping tool according to claim 1, wherein the second body member includes two or more independent screw receivers, whereby a drive screw of the drive screw assembly mates with one of the two or more independent screw receivers.

3. The clamping tool according to claim 1, wherein the second body member of the tool body includes at least one pair of guide pin bushings, whereby the pair of guide pins of the drive screw assembly are received by the at least one pair of guide pin bushings.

4. The clamping tool according to claim 1, wherein the length of each of the pair of guide pins are shorter in length than the space between the first body member and the second body member of the tool body.

5. The clamping tool according to claim 1, wherein there are two or more pairs of guide pin bushings in the second body member of the tool body.

6. The clamping tool according to claim 1, wherein the first backstop includes a receiver section which is configured to receive and support a removable tool die.

7. The clamping tool according to claim 6, wherein the removable tool die is comprised of a block with a rib receivable by the receiver section of the removable tool die, the rib also including a detent notch.

8. The clamping tool according to claim 6, wherein the removable tool die is an adjustable foot stop comprised of a longitudinal frame with a cavity supporting a clip, the clip being able to move within the cavity and a foot releasably coupled to the clip, whereby when the foot is rigidly secured to the clip, the clip is securely positioned at a location within the cavity of the longitudinal frame.

9. The clamping tool according to claim 1, wherein the second backstop includes a receiver section which is configured to receive and support a removable tool die.

10. The clamping tool according to claim 9, wherein the removable tool die is comprised of a block with a rib received and supported by the receiver section of the removable tool die, the rib also including a detent notch.

11. The clamping tool according to claim 9, wherein the removable tool die is an adjustable foot stop comprised of a longitudinal frame with a cavity supporting a clip, the clip being movable within the cavity and a foot releasably coupled to the clip, whereby when the foot is rigidly secured to the clip, the clip is securely positioned at a location within the cavity of the longitudinal frame.

12. The clamping tool according to claim 1, wherein the first backstop is comprised of a tool tip receiver, the tool tip receiver configured to receive and support a substantially round tool tip.

13. The clamping tool according to claim 1, further comprising a detent spring plunger coupled to the first body member adjacent to one of the two or more independent backstop bushings of the tool body.

14. The clamping tool according to claim 13, wherein a detent ball of the detent spring plunger is received by a recess in the backstop pin of the first backstop, whereby the detent ball releasably secures the first backstop to the first body member of the base member of the tool body.

15. The clamping tool according to claim 1, wherein the drive screw assembly includes a drive screw with a spherical rod end which is releasably received by a ball receiver mounted to the second backstop, whereby when the spherical rod end of the drive screw is forcibly pressed into the ball receiver, the second backstop is coupled to the drive screw.

16. The clamping tool according to claim 15, wherein the ball receiver is constructed of a pliable material with a modulus of elasticity between 1.0 and 20.0 GPa.

17. The clamping tool according to claim 1, wherein the handle of the drive screw assembly is removable from the drive screw assembly.

18. A clamping tool of the type including a C-shaped body and a drive screw with a threaded portion in mechanical communication with a threaded receiver in one end of the C-shaped body, the clamping tool including:

at least two threaded receivers in one end of the C-shaped body, each adapted to separately and independently receive and support the threaded portion of the drive screw;

a backstop with a backstop pin extending from a surface of the backstop;

a pair of guide pins movably coupled to one end of the C-shaped body; and at least two independent backstop bushings in a second end of the C-shaped body, the at least two independent backstop bushings each adapted to receive and support the backstop pin of the backstop, whereby the backstop may be positioned on the second end of the C-shaped body in a first position with the backstop pin in a first backstop bushing and moved to a different location with the backstop pin in a second bushing.

19. The clamping tool according to claim 18, further comprising a second backstop on a first end of the drive screw and a handle on a second end of the drive screw, whereby the combination of the second backstop, the drive screw, the pair of guide pins and the handle comprising a drive screw assembly.

20. The clamping tool according to claim 19, wherein a first end of the C-shaped body includes at least one pair of guide pin bushings, whereby the pair of guide pins of the drive screw assembly are received by the at least one pair of guide pin bushings.

21. The clamping tool according to claim 19, wherein the drive screw includes a spherical rod end which is releasably received by a ball receiver mounted to the second backstop, whereby when the spherical rod end of the drive screw is forcibly pressed into the ball receiver, the second backstop is coupled to the drive screw.

22. The clamping tool according to claim 21, wherein the ball receiver is constructed of a pliable material with a modulus of elasticity between 1.0 and 20.0 GPa.

23. The clamping tool according to claim 18, wherein the backstop includes a receiver section which is configured to receive and support a removable tool die.

24. The clamping tool according to claim 23, wherein the removable tool die is an adjustable foot stop comprised of a longitudinal frame with a cavity supporting a clip, the clip being movable within the cavity and a foot releasably coupled to the clip, whereby when the foot is rigidly secured to the clip, the clip is securely positioned at a location within the cavity of the longitudinal frame.

* * * * *